US010195864B2

(12) United States Patent
Kręczewski et al.

(10) Patent No.: US 10,195,864 B2
(45) Date of Patent: Feb. 5, 2019

(54) INKJET PRINTER FOR THE LABELING OF GOODS, COMPRISING A FILTER, AND A FILTER OF SUCH AN INKJET PRINTER

(71) Applicant: EBS Ink Jet Systeme GmbH, Nuembrecht (DE)

(72) Inventors: Radosław Kręczewski, Wrocław (PL); Grzegorz Zięba, Wrocławskie (PL); Waldemar Grabowski, Oława (PL)

(73) Assignee: EBS INK JET SYSTEME GMBH (DE)

( * ) Notice: Subject to any disclaimer, the term of this patent is extended or adjusted under 35 U.S.C. 154(b) by 0 days.

(21) Appl. No.: 15/484,557

(22) Filed: Apr. 11, 2017

(65) Prior Publication Data

US 2017/0291424 A1 Oct. 12, 2017

(30) Foreign Application Priority Data

Apr. 12, 2016 (DE) ..... 10 2016 106 686

(51) Int. Cl.
*B41J 2/175* (2006.01)

(52) U.S. Cl.
CPC ..... *B41J 2/17563* (2013.01); *B41J 2/17596* (2013.01)

(58) Field of Classification Search
CPC ..... B41J 2/17563; B41J 2/17596; B41J 2002/14403; B41J 2002/175
See application file for complete search history.

(56) References Cited

U.S. PATENT DOCUMENTS

| | | | | |
|---|---|---|---|---|
| 7,434,900 | B2 | 10/2008 | Slomianny et al. | |
| 9,061,507 | B2 | 6/2015 | Slomianny et al. | |
| 2011/0080457 | A1* | 4/2011 | Nagamine ..... | B41J 2/085 347/93 |

FOREIGN PATENT DOCUMENTS

| | | | |
|---|---|---|---|
| DE | 19650379 | A1 | 6/1998 |
| EP | 1064153 | B1 | 8/2003 |
| WO | 2013120702 | A1 | 8/2013 |

* cited by examiner

*Primary Examiner* — Juanita D Jackson
(74) *Attorney, Agent, or Firm* — McCarter & English, LLP

(57) ABSTRACT

An inkjet printer for the labeling of goods has a housing having outlet openings for ink droplets on a front face, a printing mechanism, and two hydraulic couplings that are accessible on the outside of the housing. Each hydraulic coupling has a mechanical connection part and an automatically closing first valve. Each automatically closing first valve has a first valve body and a first pusher connected to the first valve body. A filter has a filter housing in which the filter medium is accommodated and on which two hydraulic mating couplings are disposed that are accessible from the outside of the filter housing. In a joined state of the two hydraulic couplings and the hydraulic mating couplings, the pushers are each in contact with each other and respectively keep the valve bodies connected to them in an opened state.

12 Claims, 5 Drawing Sheets

Fig. 6
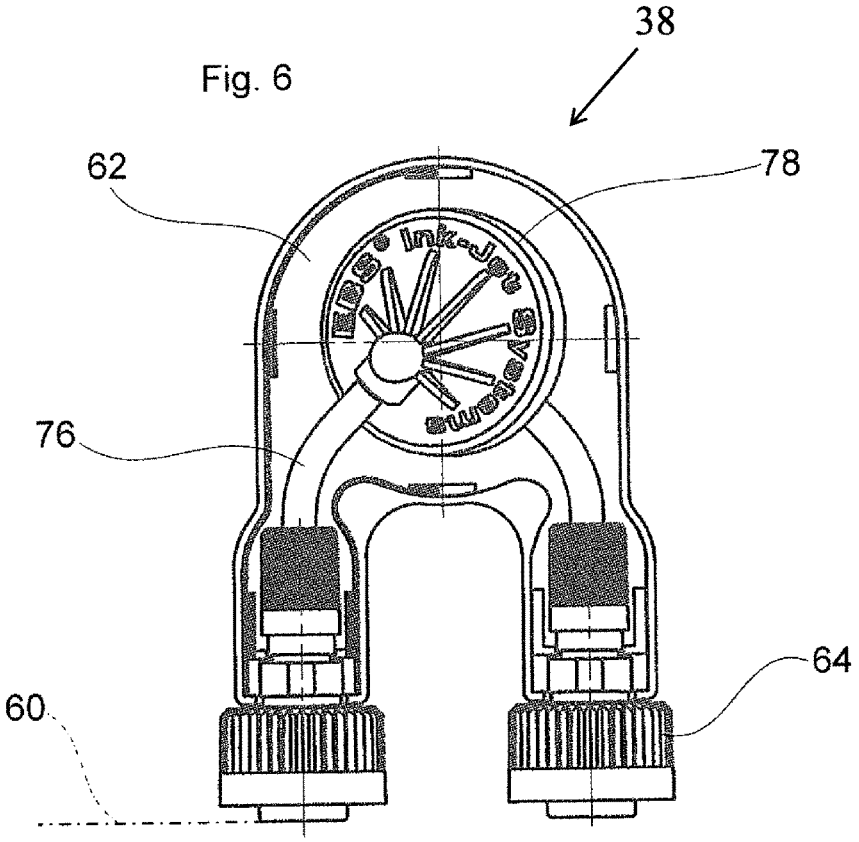
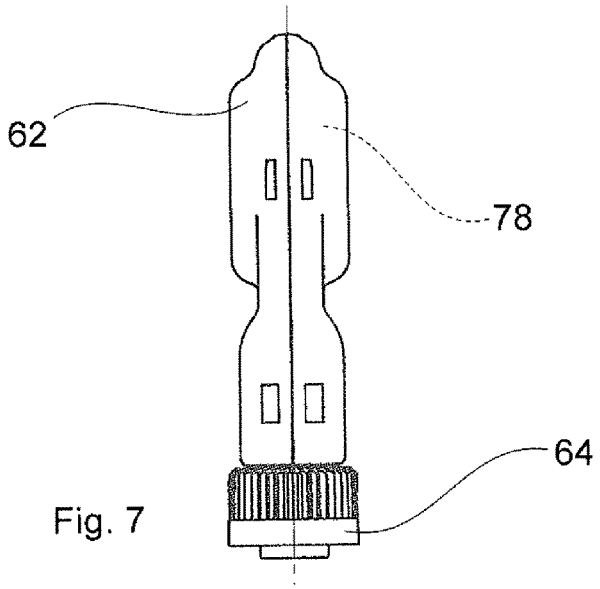
Fig. 7

INKJET PRINTER FOR THE LABELING OF GOODS, COMPRISING A FILTER, AND A FILTER OF SUCH AN INKJET PRINTER

This application claims priority under 35 U.S.C. §§ 119 (a)-(d) to German application no. DE 10 2016 106 686.9 filed Apr. 12, 2016, which is hereby expressly incorporated by reference as part of the present disclosure.

FIELD OF THE INVENTION

The invention relates to an inkjet printer for the labeling of goods, comprising a housing which a) has at least one outlet opening for ink droplets on a front face, in which housing are disposed b) a printing mechanism connected to this outlet opening, c) a pump for a liquid of the ink droplets and d) an electronic control system, and e) with a filter for the liquid. Further, it relates to a filter of such an inkjet printer.

BACKGROUND

The invention relates both to such inkjet printers in the form of handheld devices, see e.g. PCT Patent Publication No. WO 2013/120702 A1, as well as in the form of stationary devices, see e.g. European Patent No. EP 1 064 153 B1. In handheld devices, the pump may be a compressed-air pump, in stationary devices, generally a liquid pump. Handheld devices are self-sufficient; like cordless screwdrivers, for example, they are equipped with an internal voltage source, in particular with a rechargeable battery. Stationary devices are generally externally supplied with voltage, e.g. via the normal power grid.

At least one storage container for a liquid that is required for the printing process and flows through the filter, such as, for example, ink, pigments or solvents, is generally part of the inkjet printer. The storage container may be disposed in the housing or detachably connected to the housing; in this regard, reference is made to PCT Patent Publication No. WO 2013/120702A1, the content of disclosure of which belongs to the content of disclosure of the present application in its entirety and is therefore incorporated herein. In practical operation, the storage container needs to be replaced relatively frequently because the liquid is constantly used up during printing and the supply is exhausted after a certain number of printing processes.

The filter also needs to be replaced relatively frequently; at least the filter medium of the filter has to be exchanged. In this case, in inkjet printers according to the prior art, the housing has to be opened in each case, and the filter has to be replaced. This procedure requires some effort and is not suitable for a customer, in particular. However, having an authorized specialist carry out the replacement of the filter entails a lot of effort and also cost. Therefore, it would be desirable to make the replacement of the filter easier. In particular, it should be possible to carry it out without any special tool, preferably without any tool whatsoever. Carrying out the replacement is supposed to be possible as cleanly as possible.

In this case, it is to be taken into account that a filter approximately has a capacity of a few hundred liters; then, the filter medium is exhausted. Typically, the capacity is about 200 liters.

SUMMARY

This is where the invention comes in. It has set itself the task to make the replacement of the filter much easier, without a special maintenance technician having to be called in for replacing the filter or the inkjet printer having to be transported to a service point.

This object is achieved, in some embodiments, with an inkjet printer with a housing defining a front face having at least one outlet opening for ink droplets thereon, a printing mechanism located in the housing and operatively connected with the outlet opening, a pump located in the housing for pumping a liquid for the ink droplets, an electronic control system located in the housing, and a filter located outside of the housing. The filter comprises a filter medium for the liquid and a filter housing receiving the filter medium. The housing further comprises two hydraulic couplings accessible from and disposed at a distance from each other on an outside of the housing. Each of the two hydraulic couplings includes a mechanical connector and an automatically closing first valve, and each automatically closing first valve has a first valve body and a first pusher connected to the first valve body. The filter housing comprises two hydraulic mating couplings accessible from the outside of the filter housing. The two hydraulic mating couplings are adapted to couple with the hydraulic couplings and disposed at a distance from each other corresponding to the distance between the two hydraulic couplings. Each hydraulic mating coupling has a mechanical counter-connector adapted to couple with a corresponding mechanical connector and detachably connectable thereto. Each hydraulic mating coupling further comprises an automatically closing second valve, and each automatically closing second valve has a second valve body and a second pusher connected to the second valve body. When the two hydraulic couplings and the two hydraulic mating couplings are joined, the corresponding first and second pushers are in contact with each other and respectively maintain the corresponding first and second valve bodies which are connected to them in an opened state.

The filter now has its own filter housing in which it is accommodated, and is located outside the housing. The filter housing is mechanically and hydraulically connected to the housing of the inkjet printer or to a housing of a storage container in a detachable manner via the two hydraulic couplings and mating couplings. The two couplings can be disengaged or reengaged without any special tool, i.e. manually.

The hydraulic couplings each have a mechanical counter-connector and a valve. The hydraulic mating couplings each have a mechanical connection counterpart and a valve. The valves are self-closing. Therefore, they are normally in a closed valve position. This is maintained by a closing spring, for example. The valves are brought into the opened position by the valve body being pressed into an opening position by the respective pusher; this takes place against the action of the closing spring or a corresponding element. In order to be able to open both valves during the plug-in process, twice the distance between the closed position and the opened position of a valve has to be covered during the plug-in process so that both valves are reliably opened. In some embodiments, the two hydraulic couplings and the two mating couplings are each constructionally identical. In some embodiments, the valves are constructionally identical.

The mechanical counter-connector of the hydraulic coupling and the mechanical connection counterpart of the hydraulic mating coupling are adapted to each other and can be connected with and detached from each other without any special accessories, just by hand. The mechanical counter-connector may be, for example, a plug-in part, a bayonet connector or a fitting with a male thread. In that case, the mechanical counter-connector is a bushing part adapted to the plug-in part, a bayonet bushing or a ring nut with a female thread adapted to the fitting with the male thread. Other configurations are possible, e.g. comprising latching projections. A kinematic reversal is also possible. The mechanical counter-connectors and connection counterparts have the task of detachably retaining the filter housing on the housing of the inkjet printer and, in some embodiments, attaching it thereto. When they are connected, the pushers of the valves come into contact with each other; the valves are thereby held in the opened position once the mechanical connection is established. Furthermore, a liquid-tight contact is obtained and a mechanical connection of the two housings is achieved.

It is advantageous if a hydraulic coupling and/or the hydraulic mating coupling has a sealing means that comes into contact with the respective other coupling part when the mechanical connection is established, thereby effecting a liquid-tight connection. Other options of obtaining a liquid-tight connection are also possible, e.g. a press fit, conical fit or the like. When the mechanical connection is established, a tight contact between the two valves involved is also established at the same time, which are tightly connected to each other thereafter.

The easier the mechanical connection means are to operate, the easier it is for a user to detach and assemble them. A simple configuration is, for example, a screw connection, bayonet connection or a simple plug-in connection, which has already been referred to.

Self-closing valves are known, for example, from German Patent Publication No. DE 196 50 379 A1. Self-closing valves are normally in a closed state.

In some embodiments, the valves may be configured in such a way that a space between the valve body in the closed state and a separating plane of the coupling region has as small a volume as possible. This so-called residual volume is filled with a liquid prior to a separation of the main body and the printing head. The liquid of the residual volume is lost. It may lead to soiling. Therefore, in some such embodiments, the valve bodies are located in the immediate vicinity of the separating plane of the coupling region in the closed state of the valve, e.g., at a distance of less than 3, or even less than 2 mm. Also, the inner diameter of the valve housing between the valve body and the separating plane may be configured with as small a cross-sectional surface area as possible; for example, it has a diameter of less than 5, in particular less than 4 mm. In some embodiments, the cross-sectional dimension of the pushers is also as large as possible. The larger the pushers, the smaller the residual volume. These measures contribute to configuring the volume to be as small as possible.

BRIEF DESCRIPTION OF DRAWINGS

Other advantages and features of the invention become apparent from the following description of exemplary embodiments of the invention, which are to be understood not to be limiting and which will be explained below with reference to the drawing. In the drawings.

DETAILED DESCRIPTION OF EMBODIMENTS

Figure 1:
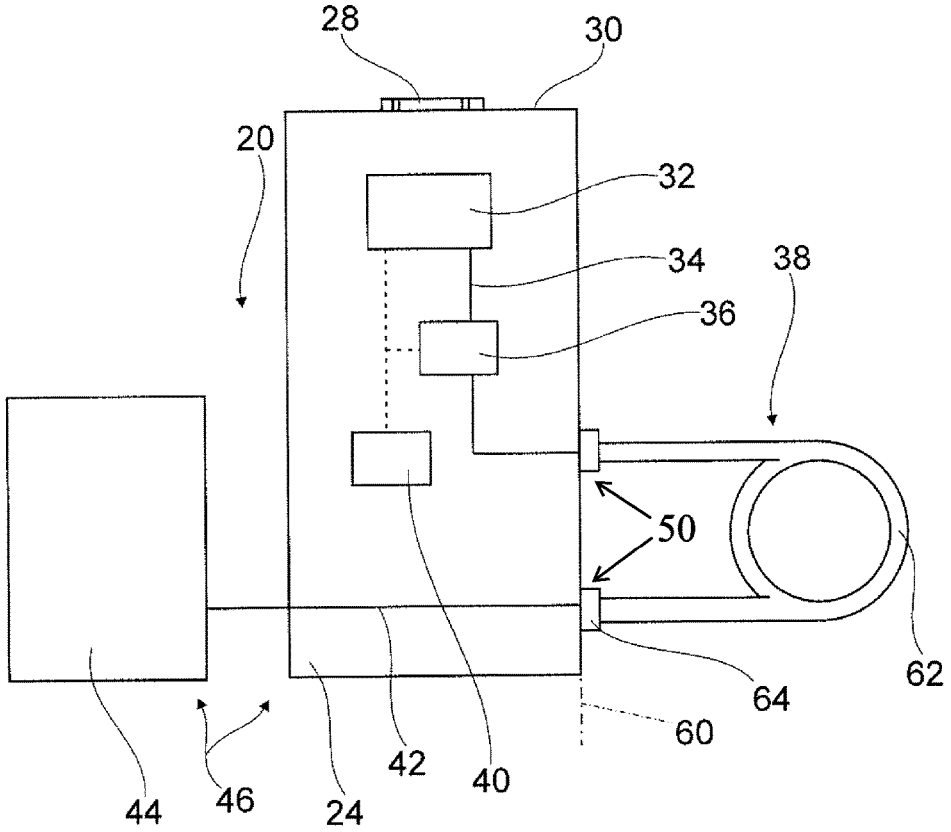
FIG. 1 shows a schematic illustration of an inkjet printer with a housing and a filter housing.

An inkjet printer is schematically illustrated in FIG. 1 in order to be able to recognize and also discuss the components thereof that are required for the following description. More specific configurations of an inkjet printer can be found, inter alia, in the above-mentioned previous publications.

The inkjet printer has a print head 20. In the known manner, the print head 20 has at least one outlet opening 28 located on a front face 30. Ink droplets supplied by a printing mechanism 32 pass through the outlet opening 28. The printing mechanism 32 is connected to a pump 36 via an ink line 34, and then to an external filter 38. The latter will be discussed in more detail below. Further, a control system 40 is provided; it is connected via electrical lines to the printing mechanism 32 and the pump 36 and controls them.

The filter 38 is connected to a storage container 44 for a liquid required for printing, in particular ink, via a supply line 42. As FIG. 1 shows, the storage container 44 is shown separately. However, it is a component of the print head 20 and forms a common housing 46 together with it.

If, as FIG. 1 shows, the print head 20 is divided into a main body 24 and a storage container 44, measures are taken so that the storage container 44 can be detachably connected to the main body housing. It is thus possible to replace storage containers 44 in a simple manner. In that case, the filter 38 is, in one embodiment, connected to the main body housing, alternatively to the housing of the separate storage container 44. In both cases, it is connected to the housing 46.

In an embodiment not shown, the storage container 44 is not separately formed; rather, the two are accommodated in a single, common housing 46.

Figure 2:
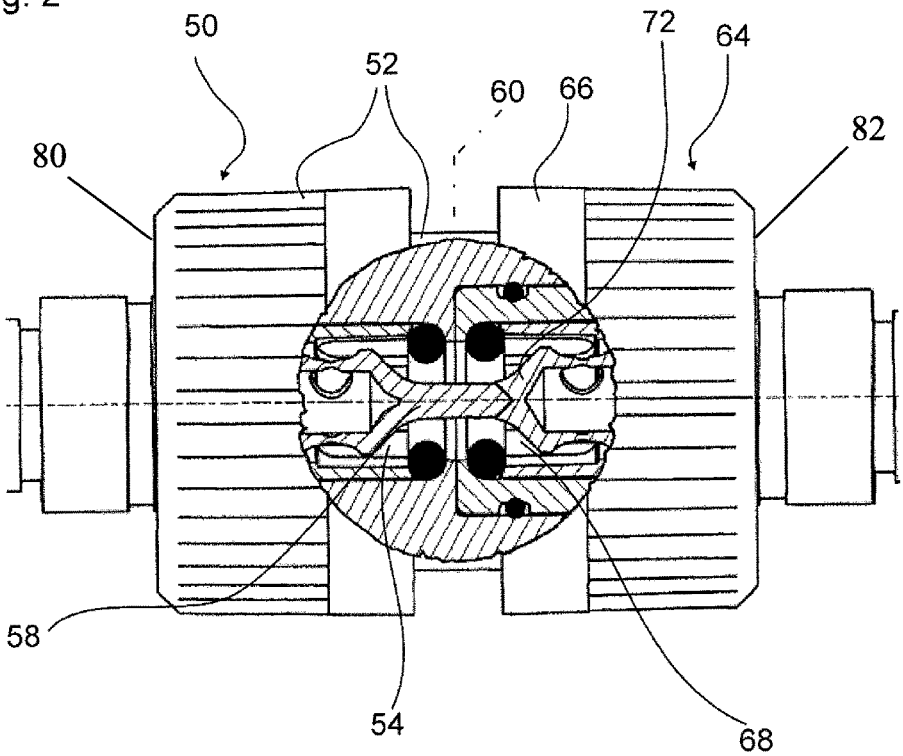
FIG. 2 shows a side view, partially in a sectional view, of a hydraulic coupling and a hydraulic mating coupling connected to it, in a coupled state.
Figure 3:
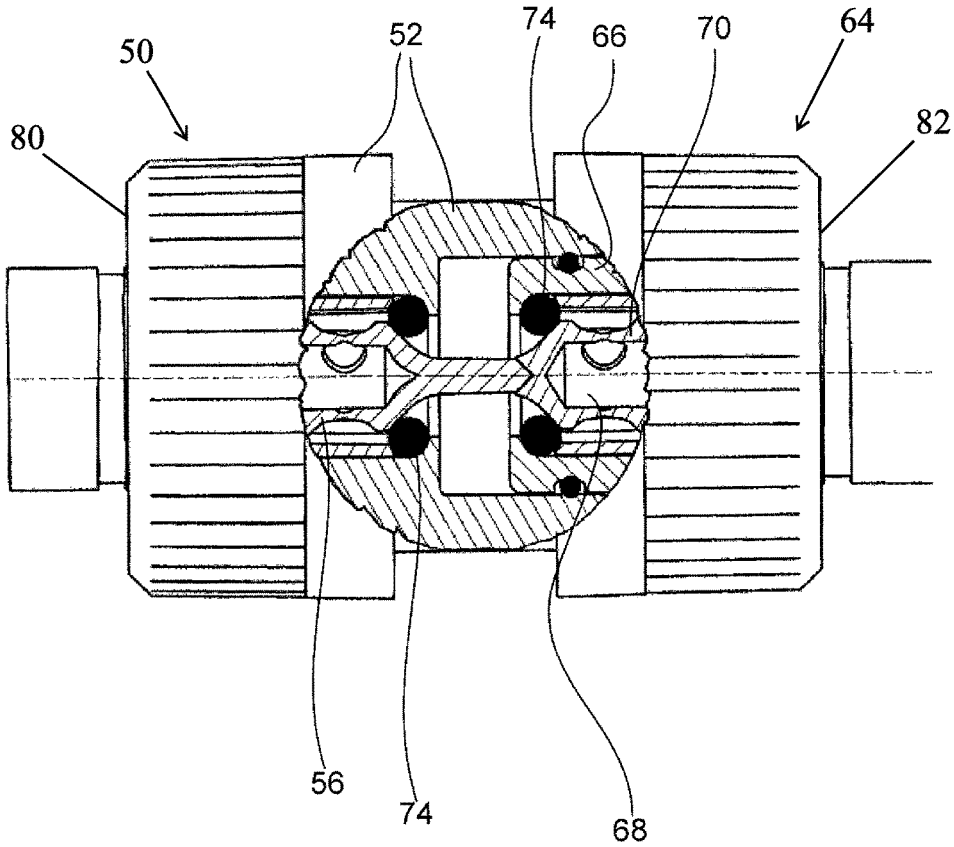
FIG. 3: shows the coupling and the mating coupling of FIG. 2 in a partially decoupled state.
Figure 4:
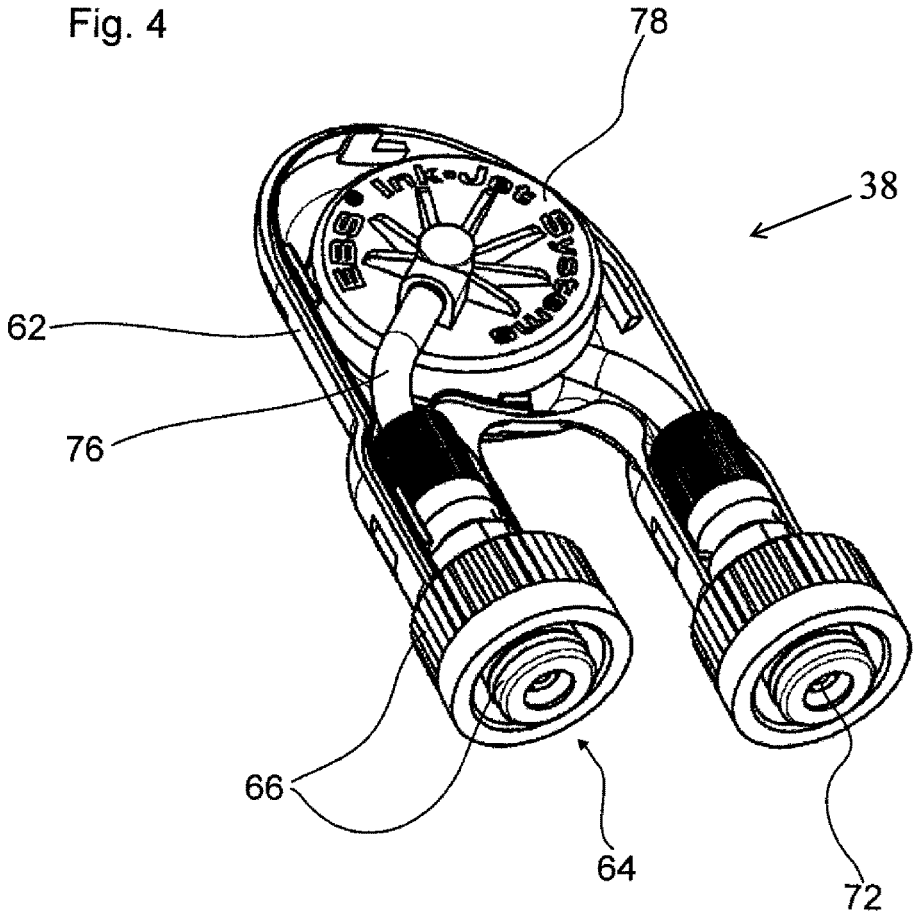
FIG. 4: shows a perspective view of a filter, partially opened
Figure 5:
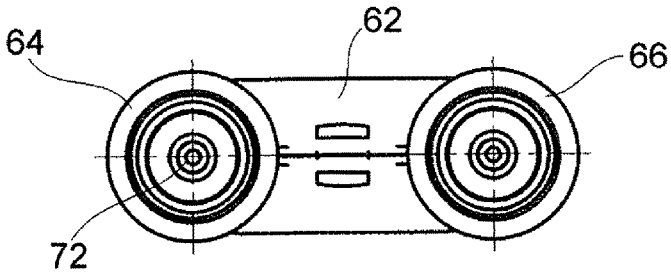
FIG. 5: shows a frontal view of the filter according to FIG. 4, FIG. 6: shows a top view of the filter according to FIG. 4, and FIG. 7: shows a side view of the filter according to FIG. 4.

The housing 46 has two hydraulic couplings 50 accessible and disposed on the outside of the housing 46. One of the hydraulic couplings 50 is connected to the ink line 34. The other is connected to the supply line 42. As shown in FIGS. 2 and 3, each hydraulic coupling 50 has a mechanical connector 52 and a first automatically closing valve 54. This first valve 54 has a first valve body 56 and a first pusher 58 connected to it. Normally, it is in a closed position. The mechanical connector 52 has at least one plug-in part and, in some embodiments, additionally a sleeve with a bayonet or a thread in order to secure the plug-in connection mechanically.

Referring again to FIG. 1, the filter 38 is connected to the housing 46 along a separating plane 60 and can be detached from it. The filter 38 is configured separately from the housing 46. As shown in FIGS. 4-7, it has a filter housing 62; a filter medium according to the prior art is accommodated in it, for example a paper disk, a filter cartridge 78 or the like. In some embodiments, a filter cartridge 78 is disposed in the filter housing 62. The filter 38 has inlet and an outlet. In some embodiments, the two are constructionally identical. The inlet and the outlet each have a hydraulic mating coupling 64 that is accessible on the outside of the filter housing 62. Each mating coupling 64 is adapted in each case to a cooperating coupling 50, as shown in FIGS. 2-3. Each mating coupling 64 has a connection counterpart 66 that has at least one bushing part adapted to the plug-in part, and, in some embodiments, additionally a bayonet or thread.

In some embodiments, the two couplings 50 are constructionally identical; also the two mating couplings 64 may be, in such embodiments, constructionally identical. The couplings 50 and also the mating couplings 64 are disposed coaxially. They have a distance from each other, measured perpendicularly to their axes, which is the same for each of the two couplings 50 and the two mating couplings 64.

In the coupled state, as shown in FIG. 2, the two couplings 50 and the mating couplings 64 come into contact in the separating plane 60, which is common to both coupling assemblies.

The hydraulic mating couplings 64 are configured to correspond to the hydraulic couplings 50. The have a second valve 68 with a second valve body 70 and a second pusher 72 connected to it. In some embodiments, the two pushers 58, 72 are connected integrally to the associated valve body 56 or 70. The mechanical connector 52 and the mechanical counter-connector 66 are adapted to each other, for example configured as plug-in connections that are, in some embodiments, secured by additional means, such as a union nut.

In the coupled state of the two coupling devices, the pushers 58, 72 are in contact with each other. In this state, the two valves 54, 68 involved are opened. The pushers 58, 72 protrude towards the respective other valve 54 or 68. They are always located within the associated mechanical connector 52 or the mechanical counter-connector 66. Moreover, they are always located within a valve housing of the respective valve 54 or 68.

In the exemplary embodiment shown, the pushers 58, 72 are configured differently. The first pusher 58 has a tip, in particular a conical free end portion. The second pusher 72 has a correspondingly configured depression, e.g. a V-shaped depression. Thus, the two pushers 58, 72 meet up reliably, as FIG. 2 shows.

In the closed state, as shown in FIG. 3, the valve bodies 56, 70 rest against the valve housing and form a seal. In order to improve the seal there, an annular seal 74 is interposed. In the coupled state, see FIG. 2, the two annular seals 74 of the two valves 54, 68 are disposed at a relatively small distance from each other. In the coupled state, the clear distance between the two annular seals 74 is less than two, or even less than one millimeter. The pushers 58, 72 are located within these annular seals 74. In the embodiment shown, the first pusher 58 protrudes from the valve body in the axial direction by at least 50% more than the second pusher 72. In another configuration that is not shown, the two pushers 58, 72 are constructionally identical.

In the coupled state of the filter 38 and the housing 46, see FIG. 2, at least one valve body 56, 70 is in contact with an end stop in the valve housing for the valve body 56, 70 (not shown). In the other one, the end stop does not have to be reached completely, only a sufficiently opened position is required. The end stop limits the path of the valve body 56, 70 in the valve housing. A closing spring (not shown, see German patent application 10 2016 106 396.7 dated Apr. 7, 2016) is disposed between the valve body and the valve housing.

In order to detach the two mating couplings 64 from the two couplings 50, the mechanical connectors 52, 66 are first disengaged. For this purpose, it is sufficient to disengage, for example unscrew, one mechanical connector 52. Then, the mating couplings 64 can be removed; FIG. 3 shows an intermediate state of the separation. In this intermediate state, the valves 54, 68 are already closed. This shows that within a relatively short distance of, for example, a maximum of three, or even a maximum of two, and in particular less than 1.5 mm separating distance, a closure of the two valves 54, 68 of each coupling device and thus a closure of all valves is obtained. Already at a clear distance of the annular seals 74 of less than 6, in particular less than 4 mm, both valves 54, 68 involved are closed. Based on FIG. 2, a distance of less than 3 mm is sufficient to bring both valves 54, 68 into the closed state.

In FIGS. 2 and 3, union nuts 80, 82 are respectively disposed to the right and to the left next to the center part shown in cross section. It is possible to use only one union nut. Thus, the left-hand union nut 80 associated with the housing 46 can be omitted.

The invention also relates to a filter which is offered on the market as a replacement part for inkjet printers. This filter is described in more detail in FIGS. 4 to 7. As is apparent from these Figures, it has a substantially round center part from which two parallel arms protrude tangentially. The mating couplings 64 are disposed at the ends of these arms. The associated valves are connected to a filter cartridge 78 via lines 76. The filter medium is located in the former. As FIGS. 6 and 7, in particular, show, the free ends of the two mating couplings 64 are located in the separating plane 60. The filter housing 62 is composed of two half-shells that are substantially constructionally identical. They are made of a central bowl-shaped part and two half-tubes attached thereto, which form a tube with a second half-shell. The mechanical connectors 66 consist of a plug-in part and a union nut which is shown here with a furrowed grip portion. The plug-in part is formed by a section of the valve housing. The plug-in part provides for the actual mechanical association, as a comparison of the FIGS. 2 and 3 shows. As FIG. 4, in particular, shows, the second pusher 72 is located entirely within the valve body or the mechanical counter-connector 66. It is thus protected.

When the filter 38 and the housing 46 are plugged together, the mechanical connectors 52 first come into contact with the mechanical counter-connectors 66. If pushed together further, the pushers 58, 72 come into contact, whereby the valves 54, 68 are opened. The state reached in this way is already sufficient for functioning. It can be additionally secured by the union nuts or other mechanical means, such as a bayonet connection. The mechanical retention is thus ensured. The union nuts do not have to be provided.

The applicant reserves the right to incorporate features from the description and the patent claims, which includes parts of sentences from the description and the claims, in a claim and, in particular, to make them the subject matter of a new patent claim.

Terms like substantially, preferably and the like and indications that may possibly be understood to be inexact are to be understood to mean that a deviation by plus/minus 5%, preferably plus/minus 2% and in particular plus/minus one percent from the normal value is possible.

While the above describes certain embodiments, those skilled in the art should understand that the foregoing description is not intended to limit the spirit or scope of the invention. It should also be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

What is claimed is:

1. An inkjet printer for the labeling of goods, comprising:

a housing defining a front face having at least one outlet opening for ink droplets thereon, a printing mechanism located in the housing and operatively connected with the outlet opening, a pump located in the housing for pumping a liquid for the ink droplets, an electronic control system located in the housing, and a filter located outside of the housing, the filter comprising a filter medium for the liquid and a filter housing receiving the filter medium;

wherein the housing further comprises two hydraulic couplings accessible from and disposed at a distance from each other on an outside of the housing, wherein each of the two hydraulic couplings includes a mechanical connector and an automatically closing first valve, and wherein each automatically closing first valve has a first valve body and a first pusher connected to the first valve body;

wherein the filter housing comprises two hydraulic mating couplings accessible from the outside of the filter housing, the two hydraulic mating couplings being adapted to couple with the hydraulic couplings and disposed at a distance from each other corresponding to the distance between the two hydraulic couplings, wherein each hydraulic mating coupling has a mechanical counter-connector adapted to couple with a corresponding mechanical connector and detachably connectable thereto, and wherein each hydraulic mating coupling further comprises an automatically closing second valve, and each automatically closing second valve has a second valve body and a second pusher connected to the second valve body, and wherein, when the two hydraulic couplings and the two hydraulic mating couplings are joined, the corresponding first and second pushers are in contact with each other and respectively maintain the corresponding first and second valve bodies which are connected to them in an opened state.

2. The inkjet printer according to claim 1, wherein the two hydraulic couplings are constructionally identical, the two hydraulic mating couplings are constructionally identical, and the filter housing is adapted so that either (i) the filter housing can be coupled to the housing in two positions differing by a 180° orientation, or (ii) the filter housing can be coupled to the housing only in a single orientation.

3. The inkjet printer according to claim 1, wherein the mechanical connector has at least one plug-in part and the mechanical counter-connector has at least one bushing part adapted to connect to the at least one plug-in part.

4. The inkjet printer according to claim 1, wherein the hydraulic coupling comprises a first valve housing and the hydraulic mating coupling comprises a second valve housing, wherein the first valve body is moveable relative to the first valve housing between a closed position and an open position, and the second valve body is moveable relative to the second valve housing between a closed position and an open position, and, when the housing and the filter housing are coupled, one or more of the first valve body or the second valve body is in contact with an end stop of said valve body.

5. The inkjet printer according to claim 1, wherein the two hydraulic couplings each define a first set of axes extending parallel to each other, and the two hydraulic mating couplings each define a second set of axes extending parallel to each other, and a distance between the first set of axes of the hydraulic couplings corresponds to a distance between the second set of axes of the hydraulic mating couplings.

6. The inkjet printer according to claim 1, wherein the hydraulic couplings define free ends, and also the hydraulic mating couplings define free ends, and wherein, when the hydraulic couplings and the hydraulic mating couplings are coupled, the free ends respectively lie in a plane that coincides with a separating plane defined by the housing and the filter.

7. The inkjet printer according to claim 1, wherein the filter housing has a disk-shaped part and two tubular arms extending tangentially therefrom and parallel to each other, and the hydraulic mating couplings are disposed on these arms.

8. The inkjet printer according to claim 1, further comprising at least one storage container for the liquid, wherein said storage container is either detachably connected to the housing or disposed in the housing.

9. The inkjet printer according to claim 1, wherein the mechanical connector has at least one plug-in part and a sleeve defining a bayonet or a female thread, and the mechanical counter-connector has a bushing part adapted to connect to the plug-in part and a sleeve defining a bayonet or a male thread.

10. A filter for an inkjet printer for the labeling of goods, comprising:

a filter medium;

a filter housing that receives the filter medium, and two hydraulic mating couplings disposed on the filter housing and that are accessible from an outside of the filter housing, wherein the two hydraulic mating couplings are disposed at a distance from each other, each hydraulic mating coupling comprises a mechanical counter-connector and an automatically closing valve, and each automatically closing valve includes a valve body and a pusher connected to the valve body.

11. The filter according to claim 10, wherein the filter housing has a disk-shaped part and two tubular arms extending tangentially therefrom and parallel to each other, and the hydraulic mating couplings are disposed on the tubular arms.

12. The filter according to claim 10, wherein the filter housing includes two half-shells that are substantially constructionally identical to each other.

* * * * *